United States Patent [19]

Little

[11] 4,134,381

[45] Jan. 16, 1979

[54] ROTARY VALVE ENGINE APPARATUS

[76] Inventor: Mark J. Little, 44 Spanish Oaks, Oakdale, Minn. 55109

[21] Appl. No.: 828,984

[22] Filed: Aug. 30, 1977

[51] Int. Cl.[2] ..... F01L 7/00

[52] U.S. Cl. ..... 123/190 E; 123/119 A; 123/80 BA; 123/190 BD

[58] Field of Search ..... 123/80 BD, 190 B, 190 BB, 123/190 BA, 190 BD, 190 DL, 190 E, 119 A, 141; 60/311

[56] References Cited

U.S. PATENT DOCUMENTS

| | | | |
|---|---|---|---|
| 1,104,059 | 7/1914 | Marr | 123/190 B |
| 1,276,242 | 8/1918 | Massey | 123/190 BB |
| 1,572,085 | 2/1926 | Risden | 123/190 BD |
| 1,619,071 | 3/1927 | Henderson | 123/190 BB |
| 1,660,166 | 2/1928 | Halse | 123/190 E |
| 1,671,284 | 5/1928 | Porter | 123/190 E |
| 1,672,564 | 6/1928 | Frazier | 123/190 BD |
| 1,977,025 | 10/1934 | Vander Elst et al. | 123/190 E |
| 2,368,956 | 2/1945 | Wehr | 123/190 BB |
| 2,853,980 | 9/1958 | Zimmerman | 123/190 B |
| 3,559,760 | 2/1971 | Ninomiya | 60/311 |

*Primary Examiner*—Ronald H. Lazarus

*Assistant Examiner*—David D. Reynolds

*Attorney, Agent, or Firm*—Merchant, Gould, Smith, Edell, Welter & Schmidt

[57] ABSTRACT

A reliable efficient rotary valve apparatus for internal combustion engines, configured for ease of installation and maintenance. Rotating valve apparatus controls transfer of intake and exhaust gases between intake and exhaust manifolds respectively of an internal combustion engine and the respective combustion cylinders thereof. Intake and exhaust portions of the rotary valve assembly are isolated by simple seal members. Activating means, responsive to rotation of the rotatable valve member, create positive fluid-flow transfer of gaseous currents through the rotating valve member. Spring biased, pressure equalizing plunger seal apparatus increases reliability and longevity of use of the rotary valve apparatus and maintains proper seals for fluid-flow passage between the rotating valve member and individual compression cylinders of the engine. Exhaust feedback apparatus with built-in spark arresters, enables controlled recycling of portions of the exhaust gases expended by the internal combustion engine during the combustion cycle.

22 Claims, 15 Drawing Figures

FIG. 10
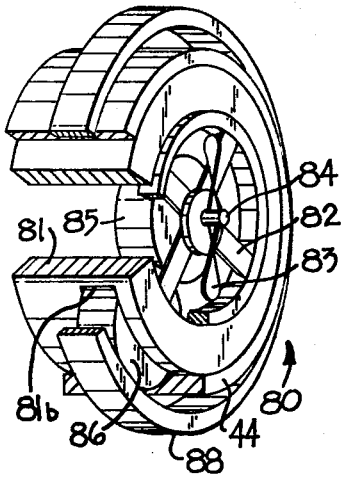
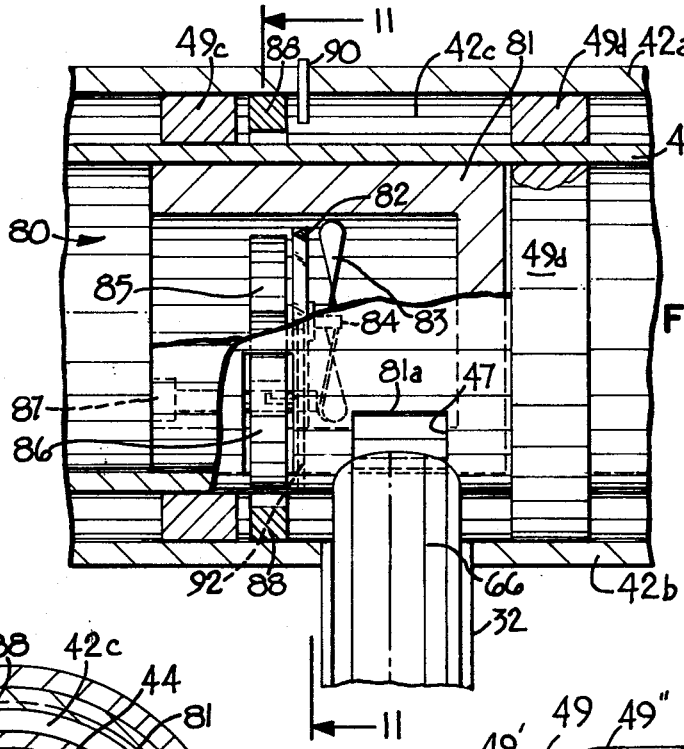
FIG. 9
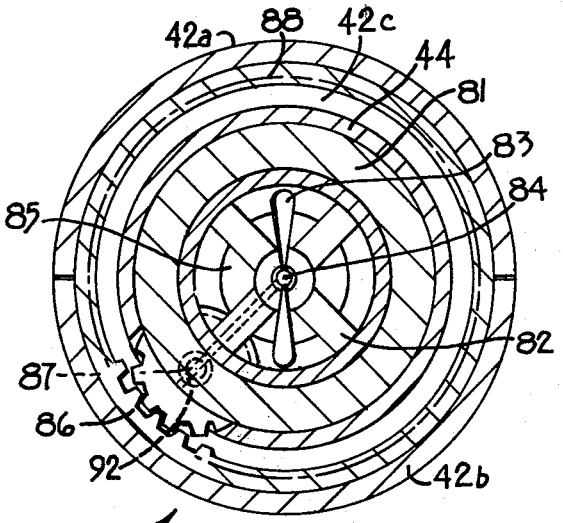
FIG. 11
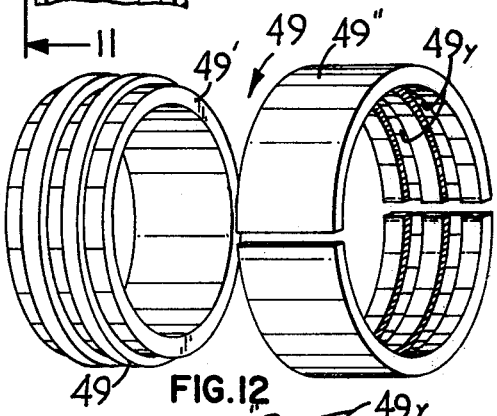
FIG. 12
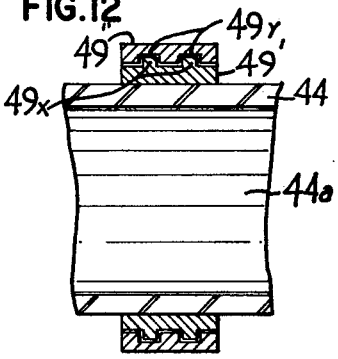
FIG. 13
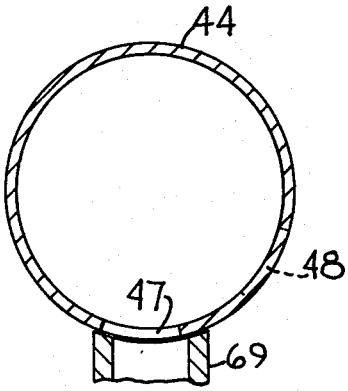
FIG. 14
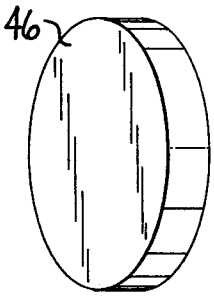
FIG. 15

ROTARY VALVE ENGINE APPARATUS

BACKGROUND OF THE INVENTION

1. Field of the Invention

This invention relates generally to internal combustion engines, and more particularly to such engines having rotary valves for controlling intake and exhaust communication with the power cylinders.

2. Description of the Prior Art

The theoretical advantages offered by internal combustion engines having rotary valves, over engines having conventional reciprocal poppet-type valves, have long been recognized. Rotary valve engines enable a significant reduction in moving parts over their poppet-type valve counterparts, proving inherent increased engine reliability thereover, smoother and quieter engine operation and reduced maintenance requirements. While several design variations of such engines have appeared in the prior art, they have not been generally accepted by manufacturers or the purchasing public because of the practical problems associated with those designs, which problems have typically outweighed the theoretical advantages of such engines. Such practical problems have typically included sealing problems, distortion, lubrication, tooling, difficulty of repair and maintenance and the cost and facility of manufacture of such rotary valve engines.

Internal combustion engines are well known in the art and generally comprise one or more compression chambers, each having intake and exhaust ports, a spark plug or other appropriate ignition element for igniting a combustible gaseous mixture within the chamber, a piston element for compressing the gaseous mixture within the compression cylinder and a crankshaft or other appropriate output drive means for transmitting the combustion energy into usable mechanical output energy. Combustible gaseous mixtures are provided from an intake manifold to the intake port of the cylinder and spent exhaust gases are expended from the exhaust port of the cylinder to an exhaust manifold by valve means which regulate and control the timed opening and closing of the intake and exhaust ports of the respective cylinders of the engine. "Rotary valve" embodiments of such valve means, to which this invention applies, include at least one rotatable member which selectively controls opening and closing of the intake and exhaust ports of the compression cylinder and selectively places the respective intake and exhaust ports of said cylinders in fluid communication with the intake and exhaust manifolds respectively of the engine.

Prior art rotary valve engines can be generally classified, according to he basic operative structure of the rotating valve member portion of the engine, into two groups or types of valve structures: (1) those in which the rotating valve member defines a plurality of fluid flow passageways which extend diametrically through the rotating valve member, for directly transmitting intake and exhaust gases respectively between the intake and exhaust manifolds and the intake and exhaust ports of the compression cylinder portions of the engine; and (2) those in which the rotating valve member defines longitudinally extending internal fluid flow passageways therein which provide fluid flow communication through single strategically located openings in the outer shell portion of the rotating valve member between the intake and exhaust manifolds and the intake and exhaust ports respectively of the compression cylinders of the engine.

U.S. Pat. No. 3,948,227 to Guenther, represents a rotary valve engine configuration of the first above-described type. A rotary valve of this type requires transfer (during the intake cycle) of the combustible fuel mixture from the intake manifold or carburation apparatus of the engine to the intake port of the compression cylinder — all during that time interval in which the respective diametrically extending valve inlet passageways of the rotating valve member are in simultaneous "alignment" with the diametrically opposed intake manifold source and the respective intake ports of the cylinders. By their operative nature, such valve structures represent inefficiency in their transfer of intake gases to the cylinders, since the combustible intake mixture must travel through the full diameter of the rotating valve member during the short "alignment". The initial delay in the receipt of intake gases by a cylinder during the intake cycle is basically the rate of flow of the gas mixture through the rotating valve member times the length of the fluid passageway through the rotating valve member. Further, with such rotating valve structures, it is difficult to pressurize the gaseous mixture in the intake manifold so as to speed the intake procedure, for increasing the horsepower of the engine. While several such pressurization techniques have been attempted in the past, they have generally been difficult to implement and have not proved to be very efficient in operation. Further, most of such attempts have been directed more toward the concept of vaporization or atomizing the fuel within the carburetor than toward actual positive pressurization of the gaseous mixture to the combustion cylinders.

U.S. Pat. Nos. 2,853,980 and 3,871,340 to Zimmerman, represent rotary valve engine configurations typical of the second above-described type. With this second type of rotary valve engine configuration, since the intake gases are always present within a longitudinal portion of the rotating valve member, there are virtually no delays associated with the transfer of combustible gases to the respective cylinders during the "intake" cycle. Upon alignment of the intake valve opening in the rotating valve member with the intake port of the respective compression cylinder, the combustible gases pass directly from the rotating valve member into the compression cylinder, with the only delay associated with the gas transfer therebetween being represented by the propagation delay of the gaseous mixture passing through the thickness of the outer wall of the rotating valve member. While rotary valve apparatus of the second type have generally proved to be more efficient than the first-described type of rotary valve apparatus with respect to their fluid transfer properties, their construction has generally been more complex and costly, and have presented more problems with the forming of reliable seals between various portions of the valve apparatus. In particular, mounting of the rotating valve member of the "second" type of valve assembly, within the engine head, has typically not enabled easy maintenance or replacement of the rotary valve portion of the apparatus or of associated internally disposed seal members. Further, with both of the above-described prior art structures, intake of the combustible mixture into the compression cylinder has depended only upon the suction or "draw" of the cylinder itself, caused by the partial vacuum created with the cylinder when the piston moves in the "downward" direction during the intake portion of the cycle. As the volume of available combustible intake mixture increases, for example with the second above-described type of apparatus, the practical effect of the "draw" is significantly reduced, basically leaving an inefficient gravity flow intake system.

The present invention overcomes the above-mentioned problems associated with both the first and second basic embodiments of the rotary valve engine structures. While the structural operation of this invention is basically of the second above-described type, it is configured in a manner which offers a high degree of simplicity and ease of maintenance and repair and which maximizes efficiency and horsepower rating of the structure without sacrificing seal reliability between the various portions of the valve apparatus.

While the present invention will be described with respect to the preferred embodiment of a rotary valve engine, it will be obvious to those skilled in the art in light of this disclosure, that other variations of the rotary valve member, the seal forming elements, the positive fluid-flow enhancing means, the exhaust feedback means and the material used herein, can be configured within the spirit and intent of this invention.

SUMMARY OF THE INVENTION

This invention provides an improved rotary valve assembly for an internal combustion engine. A cylindrical valve member is mounted by means of a plurality of bearing members within a stationary housing, for rotation about its longitudinal axis. This stationary housing is segmentable, along that portion of its length which houses the rotating valve member, for providing ease of removal and replacement of the rotating valve member. The rotary valve member and surrounding stationary housing, in combination define a first cavity therebetween. An intake exhaust manifold is connected to the stationary housing and provides a fluid flow path for intake gasseous mixtures from a carburetor to the first defined cavity. An exhaust manifold is also connected to the stationary housing and provides a fluid-flow for removal of exhaust gases from the first defined cavity. The intake and exhaust manifold openings into the first defined cavity are longitudinally spaced therealong to correspond with longitudinally spaced intake and exhaust portions of the rotating valve member.

Rotatable friction seal mambers mounted within the first defined cavity between the rotary valve member and the stationary housing, and seal plug members inserted within the internal cavity of the rotary valve member, longitudinally separate and define intake and exhaust segments of the rotating valve/housing assembly, such that at least one such intake and one exhaust segment are available for servicing each combustion cylinder of the internal combustion engine with which the valve assembly is used. Circumferentially spaced passageways through the outer wall of the rotary valve member at both the intake and exhaust segments thereof, provide fluid flow communication between the first defined cavity and the respective intake and exhaust internal cavity portions of the rotating valve member. Blade or vane means mounted at the circumferentially spaced passageways provide a blower effect as the rotating valve member rotates, for positively directing gaseous fluid flow through the respective passageways.

The longitudinally spaced intake and exhaust segments of the rotatable valve member further respectively have intake and exhaust valve access ports formed through the outer wall of the rotating valve member. Double plunger seal assemblies operatively connect the rotating valve member with the combustion cylinders, with one each of said plunger seal assemblies being operatively associated with each of said intake and exhaust valve access ports. The respective input and exhaust valve access ports which service a particular internal combustion cylinder are relatively angularly spaced on the rotatable valve member with respect to one another so as to respectively communicate with the plunger seal assemblies of the combustion cylinder being served thereby, in proper timed sequence as required by the particular combustion firing schedule of the combustion cylinder. Each plunger seal assembly includes reciprocably spring biased plunger elements which cooperate to slidably sealingly engage the rotating valve member at positions therealong which align with the respective intake and exhaust access openings of the rotating valve member, for providing a continuously sealed passageway between the internal valve cavity and the combustion chamber of the combustion cylinder when the respective intake and exhaust access openings are rotatably aligned with the plunger assembly. Spring biased equalizing lever means applies uniform sealing engagement pressure to the plunger elements, to insure a tight sliding seal of the plunger elements with the rotating valve member, even after the rotating valve member and plunger elements have experienced a high degree of wear.

Impeller means mounted within the internal cavity of the rotating valve mmber, and positively driven by drive means responsive to the rotation of the valve member, atomize and pressurize intake fuel mixtures within the rotating valve member for positive injection thereof into the combustion cylinders during the intake stroke of the combustion cycle. Controlled exhaust feedback means, enable the controlled reburning of a portion of the exhaust gases ejected through the exhaust manifold during the combustion cycle. Spark arrester means within the exhaust feedback loop removes sparks and hot particulate particles from the exhaust gases prior to recycling thereof into the carburetor or intake manifold of the internal combustion engine. Timing drive means connected to the crank shaft of the internal combustion engine coordinate and control the timed rotation of the rotating valve member, for synchronous rotation thereof with respect to the particular steps of portions of the combustion cycle or sequence required for operation of the combustion cylinders of the internal combustion engine with which the rotary valve assembly is employed.

While the present invention will be described with respect to a preferred embodiment thereof, which illustrates preferred structures and configurations of various portions thereof, it will be understood that numerous variations of the basic concepts and precepts disclosed in the preferred, can be configured within the spirit and broad scope of this invention. Further, while the preferred embodiment of the invention will be disclosed with respect to its applicable use with a four-cycle internal combustion engine, it will be understood that the invention applies equally well to other applicable uses thereof. Also, while a particular alternating intake/exhaust/intake/ . . . rotating valve configuration is disclosed in the preferred embodiment, it will be understood that other non-alternating configurations can be envisioned within the scope of this invention. Likewise while the invention is described with respect to its applicability to a single combustion cylinder, or to several in-line such combustion cylinders, those skilled in the art will recognize numerous alternate configurations of the basic valve assembly for use with internal combustion engines having varied cylinder configurations and arrangements.

BRIEF DESCRIPTION OF THE DRAWING

Referring to the Drawing, wherein like numerals represent like parts throughout the several views:

FIG. 9 is an enlarged sectional view, with portions thereof broken away, of the impeller assembly portion of the rotary valve assembly disclosed in FIG. 2, at an intake chamber portion thereof;

FIG. 10 is a perspective view, with portions thereof broken away, of a portion of the impeller assembly illustrated in FIG. 9;

FIG. 11 is a sectional view illustrating the impeller assembly disclosed in FIG. 9, generally taken along the Line 11—11 of FIG. 9;

FIG. 12 is an exploded perspective view of one of the two-part seal members disclosed in FIG. 2, illustrating the inner and outer relatively moveable portions thereof;

FIG. 13 is a cross sectional view of the seal member disclosed in FIG. 12, illustrating the operative mounting of the seal within the rotary valve assembly of FIG. 2.

FIG. 14 is a cross sectional view of the rotating valve member portion of the rotary valve assembly of FIG. 1, illustrating the relative angular spacing of the intake and exhaust valve access ports therethrough, generally as viewed along the Line 14—14 of FIG. 1; and FIG. 15 is an enlarged perspective view of a sealer plug portion of the rotary valve assembly disclosed in FIG. 1.

DESCRIPTION OF THE PREFERRED EMBODIMENT

Figures 1, 2:
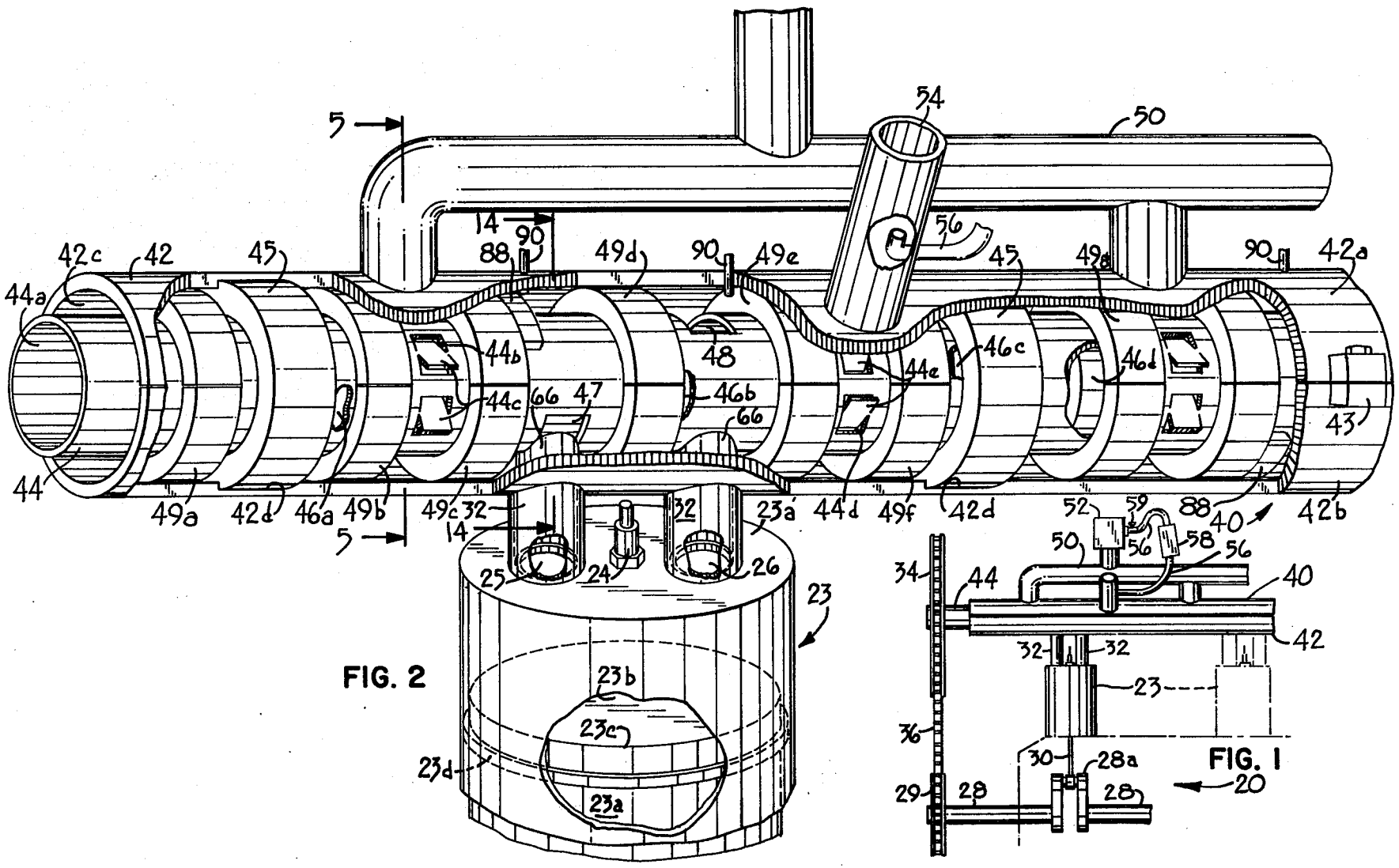
FIG. 1 is a schematic block diagram of a portion of an internal combustion engine which employs the rotary valve assembly of the present invention.
FIG. 2 is an enlarged perspective view, with portions thereof broken away, or the rotary valve assembly portion of the engine disclosed in FIG. 1.

Referring to the figures, wherein like numerals represent like parts throughout the several views, there is generally illustrated at 20 in FIG. 1, a schematic block diagram representation of a portion of an internal combustion engine which employs the rotary valve assembly of this invention. Referring thereto, there is generally illustrated an internal combustion engine block 22 having one or more internal combustion cylinders 23. It will be appreciated that the engine 20 may include any suitable number of the combustion cylinders 23. The combustion cylinders 23 may be of any type well-known in the internal combustion engine art, and generally include a cylindrical wall 23*a* forming an internal cavity 23*b* between a first end 23*a*′ of the cylindrical wall 23*a*, and a piston 23*c*, which longitudinally reciprocates within the cylindrical wall 23*a*. Sliding seal means are typically formed between the reciprocable piston 23*c* and the cylindrical wall 23*a* by means of a plurality of annular rings 23*d*, which are connected to and reciprocate with the piston 23*c* for preventing bypass of gaseous mixtures from the cavity 23*b* around the outer circumference of the piston 23*c*. A sparkplug 24 or other ignition element projects through the first end 23*a*′ of the cylindrical wall 23*a* and into the internal cavity 23*b* of the cylinder 23, for selectively igniting combustible gases therein. An inlet or "intake" port 25 and an outlet or "exhaust" port 26 are also formed through the first end 23*a*′ of the cylinder 23 and provide access to the internal cavity 23*b* by means of the rotary valve apparatus of this invention, hereinafter described. It will be understood that the sparkplug 24 is appropriately operatively connected to an electrical timing apparatus, which could be of a "distributor"-type (not illustrated), well-known in the art, for selectively energizing the sparkplug 24 in timed sequential relationship with the operative longitudinal position of the piston 23*c* within the respective combustion cylinder 23 with which the sparkplug is associated, and the operative position of the respective rotary valve apparatus (hereinafter described in more detail), which sequentially controls opening and closing of the inlet and outlet ports 25 and 26 to the respective cylinder 23.

A crank shaft 28 is journaled (not illustrated) in the crank case or block 22 of the engine 20. One end of the crank shaft 28 is connected to a first timing gear 29, and the opposite end of the crank shaft 28 is connected in well-known fashion to a fly wheel (not illustrated). The respective crank portions 28*a* of the crank shaft 28 are operatively connected in well-known manner by means of a piston rod or connecting rod member 30 to the piston 23*c*, for controlling the reciprocal movement of the piston 23*c* within the cylinder 23.

The intake and exhaust ports 25 and 26 of the respective cylinders 23 are operatively connected by means of generally cylindrical protective casing or tube members 32 to an outer stationary housing portion 42 of a rotary valve assembly, generally designated at 40. Since the details of construction of the tube members 32 which connect the intake and exhaust ports 25 and 26 respectively to the rotary valve assembly 40 are generally alike in construction, except for their respective functions with respect to operation of the engine 20, a further description of one such tube member and its internal plunger assembly (hereinafter described) will suffice to cover the application thereof for either an "intake" or an "exhaust" function. The rotary valve assembly 40 further has a primary rotating valve member 44 mounted for rotation (as hereinafter described) within the stationary housing 42 of the valve assembly 40. A second timing gear member 34 is mounted adjacent one end of the primary rotating valve member 44, for rotation therewith and is rotatably connected to the first timing gear member 29 by means of a drive chain 36. The first and second timing gear members 29 and 34 respectively are sized to provide a rotation ratio of 2:1 (i.e. the driving gear 29 rotates twice for each revolution of the driven gear 34). As will become apparent upon a more detailed description of the invention, however, it will be understood that any appropriate gear ratios and timed driving means for the primary rotating valve member 44 can be envisioned within the spirit and scope of this invention.

An intake manifold 50 is illustrated in FIG. 1 as generally extending from a carburetor 52 into operative sealed connection with the stationary housing portion 42 of the valve assembly 40. As will become apparent upon a more detailed description of the preferred embodiment of the invention, the intake manifold 50 is illustrated as operatively connected to the stationary housing 42 at two longitudinally spaced positions therealong, corresponding to two combustion cylinders 23 of the engine 20. It will be understood that the intake manifold can be extended to service any number of combustion cylinders 23 of the engine 20. The intake manifold is configured to provide a passageway for combustible gaseous mixtures from the carburetor 52 to the internal chamber formed by the stationary housing 42, as hereinafter described. An exhaust manifold 54 is illustrated in FIG. 1 as extending from the stationary housing 42 of the rotary valve assembly 40, and provides an outlet or exhaust passageway therefrom, as hereinafter described in more detail, for spent or burned exhaust gases ejected from the underlying engine cylinder 23. While only one exhaust tube or passageway 54 of the exhaust manifold is illustrated in FIG. 1, it will be understood that at least one such tube is provided for each of the combustion cylinders 23, as will become apparent upon a more detailed description of the preferred embodiment. An exhaust gas feedback conduit 56 operatively extends between the exhaust tubes 54 of the exhaust manifold, back to the carburetor 52 for providing recycling or reburning of a portion of the exhaust gases. A spark arrester assembly 58 is operatively interposed within the exhaust feedback conduit 56, for removing sparks and highly combustible particles from the recycled exhaust gases, prior to introduction of the recycled exhaust gases into the carburetor 52. Valve means 59 are also provided within the exhaust recycling conduit 56 for controlling the rate of flow of recycled exhaust gases through the feedback conduit 56. While a specific example of an exhaust recycling and spark arrester configuration will be illustrated with respect to the preferred embodiment of this invention, it will be understood that numerous variations of these configurations can be envisioned within the spirit and scope of this invention.

An enlarged perspective view of the rotary valve assembly portion 40 of the engine 20 is illustrated in FIG. 2. Referring thereto, it will be noted that the stationary housing 42, for ease of assembly and maintenance, comprises a two-part construction having an upper housing portion **42*a* and a lower housing portion 42*b* bolted together by appropriate bolt means 43 at appropriate locations along the longitudinal length of the housing 42 so as to define a cylindrical internal cavity, generally designated at 42*c*. As illustrated in FIG. 2, the inner wall of the housing 42, when operatively secured by the bolt means 43 as illustrated, defines annular race or groove portions 42*d* at axially spaced positions therealong, sized to matingly accept bearings 45. In the preferred embodiment of the invention illustrated in FIG. 2, there are two such bearings 45, one located at each side of the underlying combustion cylinder 23. It will be understood that while the invention will be described with respect to its application to a single combustion chamber, the principles of the rotating valve assembly can be extended to apply to the serving of any number of combustion cylinders 23, whether of an "in-line" type, the well-known "V-type" or any other type of combustion cylinder arrangement, by appropriate extension of the principles of this invention. For example, it will be understood that the housing 42 can be appropriately extended to service additional combustion chambers 23, in which case additional operative members such as the bearings 45 would be required at appropriate axially spaced positions along the housing 42**.

The bearings 45 rotatably support the primary rotating valve member 44 within the internal cavity **42*c* of the housing 42, and may be of any appropriate configuration, such as roller or ball bearings. In the preferred embodiment, the primary rotating valve member 44 comprises a cylindrical tube member defining an internal cylindrical cavity 44*a* and is rotatable by means of the second timing gear 34 in the clockwise direction, as viewed from the left end of the valve assembly 40 disclosed in FIG. 2. The materials used for constructing the housing 42 and the primary rotating valve member 44** may be any appropriate material suitable for withstanding the operative heat and wear conditions of the device, as hereinafter described.

Figure 5:
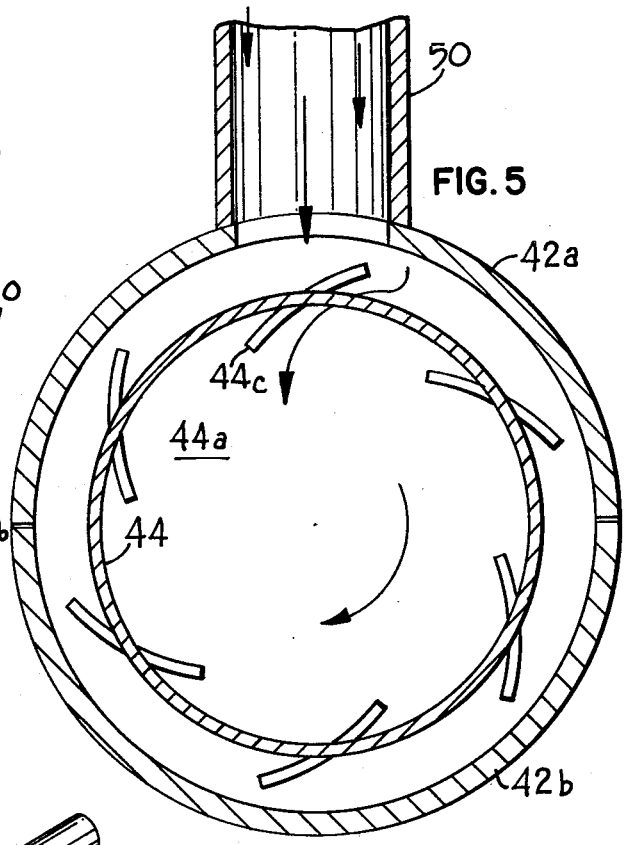
FIG. 5 is a cross sectional view of the rotating blade portion of the rotary valve assembly at an intake chamber portion thereof, generally taken along the Line 5—5 of FIG. 2.

Referring to FIG. 2, that portion of the rotary valve assembly located between the axially spaced bearings 45 generally comprises the rotary valve structure for controlling the flow of intake and exhaust gases to and from respectively the intake and exhaust ports 25 and 26 respectively of the combustion cylinder 23 illustrated. The following discussion will specifically apply to the rotary valve structure 40 as applicable to controlling the intake and exhaust for the single illustrated combustion chamber 23; it being understood that the below-described principles can readily be extended to encompass the valve control apparatus for any number of such in-line combustion cylinders 23. The primary rotating valve member 44 has a plurality of "intake" passageways **44*b* formed through the cylindrical wall portion of the rotating valve member 44 and circumferentially spaced thereabout in an annular ring, enabling fluid communication between the internal cavity 44*a* of the valve member 44 and that portion of the internal cavity 42*c* which is disposed between the housing 42 and the outer surface of the rotating valve member 44. The intake passageways 44*b* through the rotating valve member 44 are radially disposed so as to generally underlie the entry position of the intake manifold 50 through the stationary housing member 42*a*, so as to form a fluid communication path from the carburetor 52, through the intake manifold 50 and to the internal cavity 44*a* of the rotating valve member 44. A plurality of vane or blade members 44*c* are mounted to or from a continuum with the rotating valve member 44 and are disposed across the intake passageways 44*b* thereof at angles relative to the outer cylindrical wall of the valve member 44 so as to enhance or "scope-in" intake gaseous mixtures from that cavity portion 42*c* surrounding the rotating valve member 44 and into the internal cavity 44*a* of the rotating valve member 44, as the valve member 44 rotates in the clockwise direction, as indicated in FIG. 2. This vane or blade assembly at the intake passageways 44*b* of the rotating blade member 44** simultaneously atomizes intake fuels for greater combustibility and provides for positive intake gas flow from the carburetor into the internal chamber or cavity 44a of the valve member 44, thus not depending upon normal gravity feed or transfer of the intake gases to the rotating valve assembly. An enlarged cross sectional view of the rotating vane or blade configuration above-described is illustrated in more detail in FIG. 5. Referring thereto, it becomes clearly apparent that intake gases flowing into the housing cavity 42c will be positively directed or "scooped" into the internal cavity 44a of the rotating valve member 44 by means of the blade or vane members 44c.

Exhaust passageways 44d are formed through the cylindrical wall protion of the rotating valve member 44, in manner similar to the above-described intake passageways 44d, so as to enable fluid communication between the internal combustion cavity 44a of the valve member 44 and that portion of the internal cavity 42c which is disposed adjacent the exhaust tube or manifold 54. The exhaust passageways 44d enable fluid communication between the internal cavity 42a and the exhuast tube or manifold 54. A plurality of vane or blade members 44e are mounted to or form a continuum with the rotary valve member 44 and are disposed across the exhaust passageways 44d thereof, at angles relative to the outer cylindrical wall of the valve member 44 so as to enhance heat removal from the exhaust plunger assembly (hereinafter described), and to enhance extraction of exhaust gases from the internal cavity 44a of the rotating valve member 44 and into the exhaust tube or manifold 54. Referring to FIG. 2, it will be noted that the angle or pitch of the intake members 44c and the exhaust blade members 44e are exactly opposite to one another, so as to effect positive fluid flow transfer respectively to and from the internal cavity 44a of the rotating valve member 44 as the valve member 44 rotates.

The internal cavity 44a of the rotating valve member 44 is axially separated into a plurality of adjacent chambers by disc-like barriers or plug-members 46, as illustrated in FIGS. 2 and 15. In the preferred embodiment, the plug barrier members comprise appropriate disc members which are press-fit into firm sealing engagement with the inner walls of the rotating valve member 44, to prevent leakage of gaseous materials between contiguous intake and exhaust portions of the internal cavity 44a. For ease of reference, the barrier elements 46 have been labeled as 46a–46d in FIG. 2. The barrier members 46a and 46b isolate the intake portion of the rotary valve member 44, defined therebetween from the exhaust portion of the rotary valve member which is defined between the barrier members 46b and 46c. The barrier members 46c and 46d, in combination, provided a dead air space within the internal cavity 44a defined therebetween, for isolating the exhaust portion of the rotary valve member of one combustion cylinder 23 from the intake portion of the rotary valve member 44 which services an adjacent combustion cylinder 23.

The rotary valve member 44 further defines an intake valve access port 47 and an exhaust valve access port 48, each respectively providing fluid communication between the respective intake and exhaust portions of the internal cavity 44a and the surrounding internal cavity portion 42c of the stationary housing 42. The intake and exhaust access ports 47 and 48 are axially spaced along the rotating valve member 44 so as to generally matingly align with the casing or tube members 32, as hereinafter described in more detail. Further, the intake and exhaust access ports 47 and 48 are operatively relatively disposed and spaced apart from one another around the outer surface of the rotating valve member 44 such that only one of the valve access ports 47 or 48 can operatively address the corresponding intake and exhaust ports of the underlying combustion chamber 23 at a time during a complete cycle of an internal combustion engine with which the rotating valve assembly is used (as illustrated in FIG. 2). The circumferential lengths of the respective intake and exhaust valve access ports 47 and 48 are, in the preferred embodiment, approximately 30° to 40° and have a rotational or circumferential spacing therebetween of approximately 30° to 40° such that as the valve 44 rotates about its axis, the respective valve access ports 47 and 48 will maintain fluid communication between their respective intake and exhaust internal cavity portions 44a of the valve member 44 for somewhat less than 90° of angular rotation of the valve 44, see FIGS. 1 and 14. It will be understood by those skilled in the art that the respective "rotational or circumferential lengths" of the valve access ports 47 and 48 and the relative circumferential spacings therebetween will depend upon the dimensions of the cooperating plunger assemblies (hereinafter described). In the preferred embodiment, the valve assembly 40 is employed with a 4-cycle internal combustion engine, such that the relative sizes and positioning of the intake and exhaust valve access ports 47 and 48 respectively coincide with the "intake" and "exhaust" portions respectively of the well-known 4-cycle internal combustion sequence.

A plurality of laminated seal members 49 (FIG. 2) are configured to provide a frictionless seal between the stationary housing 42 and the rotating valve member 44, so as to prevent the flow of gaseous mixtures therebetween through the internal cavity 42c. For convenience in describing relative positioning of the laminated seal members 49, these elements have been labeled as 49a–49h in FIG. 2. The seals 49a and 49b prevent the flow of intake gases out of the end of the housing 42. The seal members 49b and 49c isolate the intake portion of the rotary valve assembly which accepts gas mixtures from the intake manifold 50. The seal member 49d isolates the intake and exhaust portions of the internal cavity 42c which are in fluid communication with the internal cavity 42a of the rotary valve assembly by means of the intake and exhaust valve access ports 47 and 48 respectively. The seal members 49e and 49f isolate that portion of the internal cavity 42c which is in fluid communication with the exhaust tube or manifold 54. The seal members 49g and 49h isolate that portion of the internal cavity 42c which is in fluid communication with the intake manifold, for serving the second combustion chamber 23. The laminated seal members 49 are illustrated in more detail in FIGS. 12 and 13. Referring thereto, an inner seal sleeve member 49' having one or more external annular rings or bands 49x thereon is press-fit onto the outer circumference of the rotating valve member 44, as illustrated in FIG. 13. An outer, split-seal portion 49' having internal circumferentially disposed grooves or races 49y is configured to cooperatively mate in close non-touching tolerance the inner portion of the seal 49' so as to form a seal therewith. The outer seal portion 49' is split so as to enable ready installation thereof, and for ease of removal of the rotating valve 44 from the housing 42 in maintenance operations. Such laminated seals are well-known in the art and may be constructed of any appropriate materials suitable for simultaneously forming the maintenance free, friction-free seal. The frictionless property of the laminated seals 49 also prevent drag upon the rotation of the rotating valve member 44.

Figure 3:
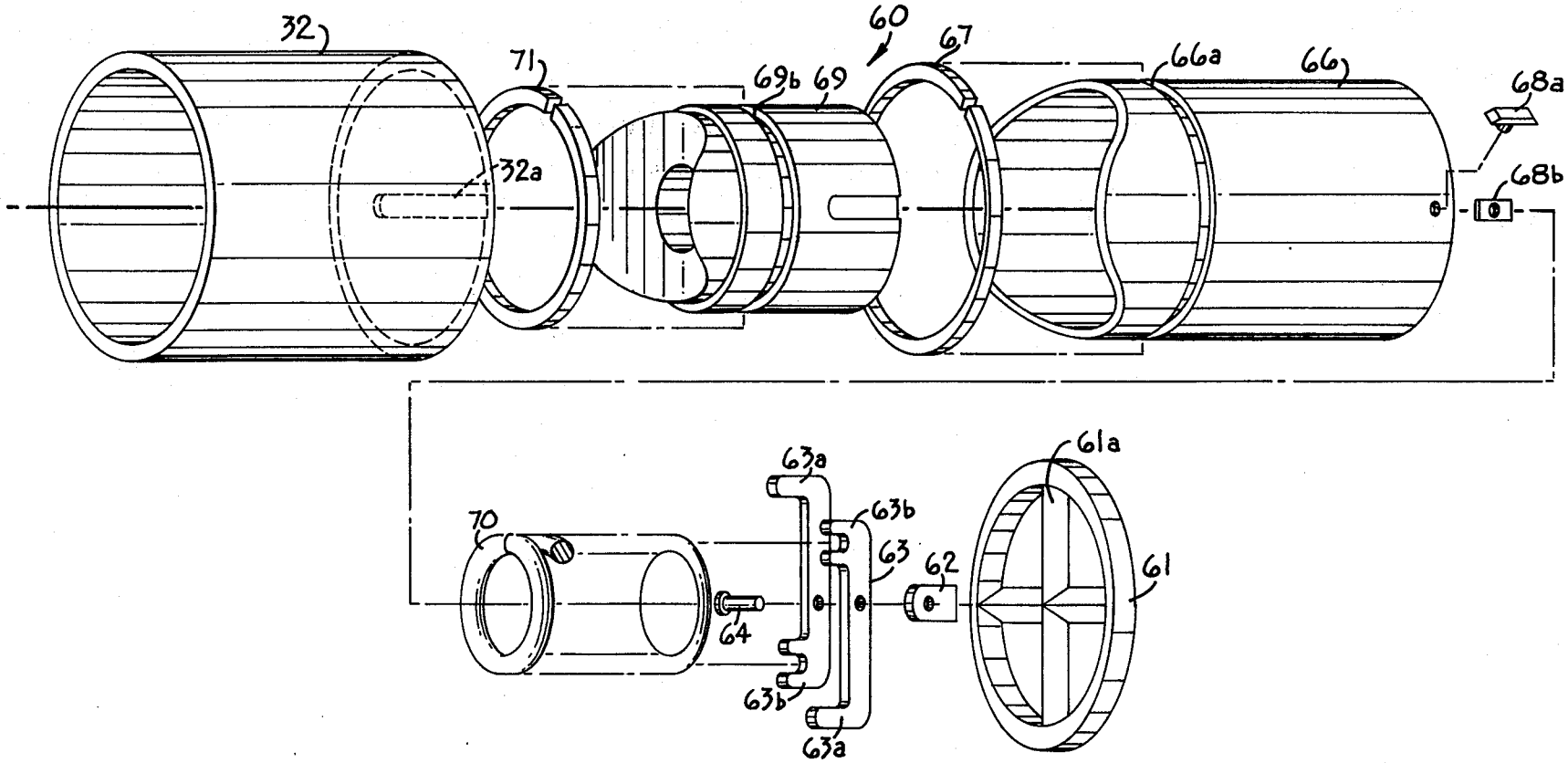
FIG. 3 is an exploded perspective view of the double plunger seal assembly portion of the rotary valve assembly disclosed in FIG. 2.
Figure 4:
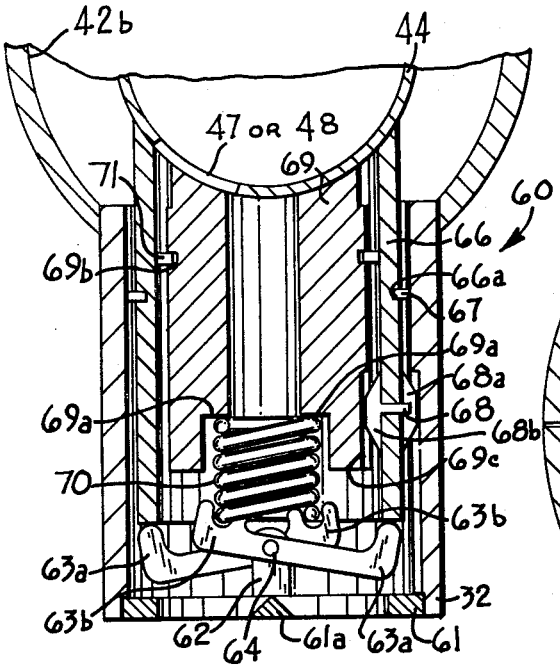
FIG. 4 is a cross sectional view of the composite plunger seal assembly disclosed in FIG. 3.

Intake and exhaust gases are transmitted between the rotating valve member 44 and the combustion cylinder 23 by means of double plunger seal assemblies 60 mounted within the protective casing or tube connecting members 32. The double plunger seal assembly 60 is illustrated in more detail in FIG. 3 (exploded view) and FIG. 4 (cross sectional view). Referring thereto, the protective casing or tube members 32 generally comprises a cylindrical cylinder mounted near its bottom edge to the combustion cylinder 23 so as to overlie the appropriate intake or exhaust ports 25 or 26 respectively thereof, and is connected at its top end to the stationary housing **42*b* (see FIG. 2), to form a fluid passageway therebetween. A ring-like bottom support member 61 is threaded into the lower end of the outer casing 32 for easy installation and maintenance removal. The bottom support member 61 has a cross grid support structure 61*a* extending diametrically there across and tapered in a manner so as to minimize the restriction of gaseous flow there through. It will be noted, that the taper of the support grid portion 61*a* of the bottom support member 61 which is illustrated in FIGS. 3 and 4 conform to a double plunger seal assembly 60 which would be used at an "intake" port, since the direction of gaseous flow there through would be from "top" to "bottom" of the seal assembly 60, as viewed in FIG. 4. For a double plunger seal assembly 60 configured for use on an "exhaust" port, the apex of the tapered or beveled support grid portion 61*a* of the support member 61 would be reversed to that illustrated in FIG. 4, so as to minimize resistance to the gaseous flow through the plunger seal assembly 60 in the direction from the "bottom" to the "top" of the seal assembly 60**.

A mounting stud member 62 axially projects from the support grid portion **61*a* of the bottom support member 61 into the inner cavity of the casing member 32. A pair of equalizing levers 63 are pivotally mounted to the mounting stud member 62 by means of a pin 64 and are pivotally rotatable about the pin 64. The equalizing levers 63 each has a first lever arm 63*a* radially extending from the mounting stud member 62 in close proximity to but spaced apart from the inner wall of the external tube 32, and a second lever arm 63*b* diametrically opposed from the first lever arm 63*a*** and terminating at a spring-retaining end configuration.

An outer sealing plunger member 66 which is generally cylindrical in shape and is open at axially opposite ends thereof rests upon the first lever arm ends of the equalizing levers 63 and is sized for reciprocable axial movement within the outer casing 32. The upper end of the outer sealing plunger member 66 is contoured to matingly slidably engage the outer surface of the rotating valve member 44, and is mounted relative to the rotating valve member 44 so as to intercept the appropriate intake or exhaust valve access port 47 or 48 (depending upon the relative port with which the plunger assembly 60 is employed). The outer sealing plunger 66 has an annular groove **66*a* about its outer circumference, which holds a ring member 67 which slidably engages the inner cylindrical wall of the cylindrical casing 32 and forms a sliding seal therebetween. The outer sealing plunger 66 further has an alignment member 68 fixedly mounted therein. The alignment member 68 has an outer key member 68*a* which slides in a key way 32*a* axially formed within the inner cylindrical wall of the outer casing member 32 for maintaining the radial attitude (i.e. for preventing rotation thereof) of the outer sealing plunger member 66 relative to the outer casing 32. The alignment member 68 further has a second key member 68*b*** projecting from its inner wall for maintaining the rotational attitude of an inner sealing plunger member (hereinafter described).

An inner sealing plunger member 69, of generally cylindrical shape is coaxially mounted for reciprocal movement within the outer sealing plunger 66. The inner sealing plunger member 69 is configured adjacent its lower end to define a spring seat **69*a*, and is contoured at its upper end to matingly sliably engage the rotating valve member 44. A spring member 70 is compressively mounted between the spring seat 69*a* of the inner sealing plunger member 69 and the spring retaining portions of the second lever arm 63*b* of the equalizing lever 63 to maintain the inner sealing plunger member 69 in tight frictional engagement with the rotating valve member 44. In the preferred embodiment, the spring 70 is a coil spring construction, however, it will be understood that other appropriate biasing configurations can be employed within the spirit and intent of this invention. The inner sealing plunger member 69 further defines an annular groove 69*b* about its outer circumference into which is inserted a ring member 71 for forming a sliding seal between the inner and outer sealing plunging members 69 and 66 respectively. The inner sealing plunger member 69 further defines a key way 69*c* axially disposed along a portion of its outer circumference for matingly accepting the inwardly directed key portion 68*b* of the alignment member 68**.

The double plunger sealing assembly 60 is cooperatively installed with the rotating valve apparatus 44 so as to compress the spring 70 between the inner sealing plunger member 69 and the underlying equalizing levers 63. Once installed, the spring 70 maintains the inner sealing plunger member 69 into tight frictional sliding engagement with the rotating valve 44, and simultaneously transmits through the second and first lever arms **63*b* and 63*a* respectively of the equalizing lever 63, support forces to the outer sealing plunger 66 for maintaining a tight frictional sliding seal between the outer sealing plunger 66 and the rotating valve 44. The equalizing levers 63, in combination with the spring 70 equalize or maintain a balance of forces by the inner and outer sealing plunger members 69 and 66 respectively against the rotating valve member 44, regardless of wear of either the inner or outer sealing plunger members. Accordingly, a tight frictional seal between the rotating valve member and the plunger assembly is insured at all times by the spring biased equalizing assembly. Intake or exhaust gases from the rotating valve 44 pass through the respective intake or exhaust valve access ports 47 and 48 respectively through the internal cavity of the inner sealing plunger member, past the spring and equalizing lever assemblies and through the grid support structure of the bottom support member 61, into or out of the respective intake or exhaust ports of the compression cylinder as the case may be. The plunger assembly is constructed for ease of maintenance due to the fact that the bottom support member 61 is threaded into the outer casing 32 for ease of removal of the entire plunger assembly apparatus 60. The rotating valve member 44 is simply removed by releasing the bolt means 43 which secure the upper and lower portions of the stationary housing 42a and 42b** respectively to one another (see FIG. 2).

Positive intake feed pressure of intake gases from the "intake" portion of the internal cavity 44a of the rotating valve 44, to the combustion cylinder 23 by means of the plunger assembly 60, is provided by means of an impeller assembly 80. Detailed views of the impeller assembly 80 are illustrated in FIGS. 9, 10 and 11 of the Drawing. The impeller assembly 80 is used in the preferred embodiment, only with the intake portion of the rotary valve, and is mounted within the rotating valve member 44 between the intake passageways 44b and the intake valve access port 47 thereof (see FIG. 2). The impeller assembly 80 is mounted to a cylindrical casing member 81, which is closed at one end, and which is press fit in tight sealing engagement within the internal cavity 44a of the rotary valve member 44. The cylindrical casing member 81 has an elongate opening 81a formed through the cylindrical wall portion thereof, which matingly aligns with the intake access port 47 of the rotary valve member 44, for providing fluid communication between the internal cavity portion of the cylindrical casing member 81 and the intake passageway of the plunger seal assembly 60 (see FIG. 9). An impeller support ring and cross bracket holding apparatus 82 is press-fit mounted within the cylindrical casing member 81 and rotatably supports an impeller blade 83 for rotation about the axis of the rotary valve member 44. The impeller blade 83 is rotatably supported upon a shaft 84 which is coaxially connected for rotation with a first gear member 85. The first gear member 85 is operatively frictionally driven by a second gear member 86 which is rotatably mounted by a pin member 87 to the cylindrical casing member 81 which contains a slot 81b through the cylindrical wall thereof to allow free rotation of the second gear member 86. An annular gear ring 88 is fixedly mounted to the internal wall of the outer casing 42, and operatively engages by means of friction or intermeshing gears, the second gear member 86. The cross-arm portions of the impeller support structure 82 are tapered, as illustrated in FIG. 10, to minimize restriction to the flow of intake gaseous mixtures thereby, and the impeller blade structure is configured for "pushing" the intake gaseous mixture past the impeller apparatus from "left-to-right" as viewed in FIGS. 9 and 10.

As the rotary valve member 44 rotates about its longitudinal axis, as driven by the crank shaft 28 by means of the gear and drive chain combination (29), (36) and (34), the second impeller gear drive member 86 operatively engages the annular gear 88 and imparts rotary motion to the impeller blade 83 by means of the first gear member 85. The net effect is that as the rotary valve member 44 rotates, the rotation of the impeller blade 83 positively directs, under pressure, the intake gaseous mixture from the intake manifold, through the rotary valve 44 and into the combustion chamber 23 via the plunger seal assembly 60 — all resulting in an increase in efficiency and horsepower rating of the motor. It will be understood that the relative sizes of the gears 86 and 85 can be varied to regulate the rotary speed of the impeller blade 83.

The rotary valve assembly 40 is lubricated through the intake gaseous mixture by means of the what is well-known in the art as an autolube impulse pump (not illustrated), that positively injects predetermined amounts of oil into the intake gas mixture. Oil lubrication ports illustrated in FIG. 2 at 90 are also provided for directly lubricating the internal gear assemblies of the rotary valve assembly 40. It will be understood that the oil lubrication ports 90 are connected to an appropriate oil source (not illustrated). Referring to FIGS. 9–11, oil lubrication passageways through the various support elements for the impeller support mechanisms are illustrated. Lubrication oil inserted through the external housing 42 through the oil lube ports 90 falls by gravity onto the rotating valve member 44. This lubrication oil also will splash upon and lubricate the annular gear 88 which in turn will lubricate the second gear member 86, which will lubricate the first gear member 85. An oil passageway generally designated at 92 in FIGS. 9–11, passes through the rotating valve member 44, through the cylindrical casing member 81 and through one of the cross-arms of the impeller support structure 82, to provide lubrication to the support shafts or pins 87 and 84 of the second gear member 86 and the impeller 83 respectively. While a specific mode of illustrating lubrication of the various moving gear portions of the preferred embodiment has been illustrated, it will be understood that many such lubrication variations can be envisioned within the spirit and intent of this invention.

Figure 6:
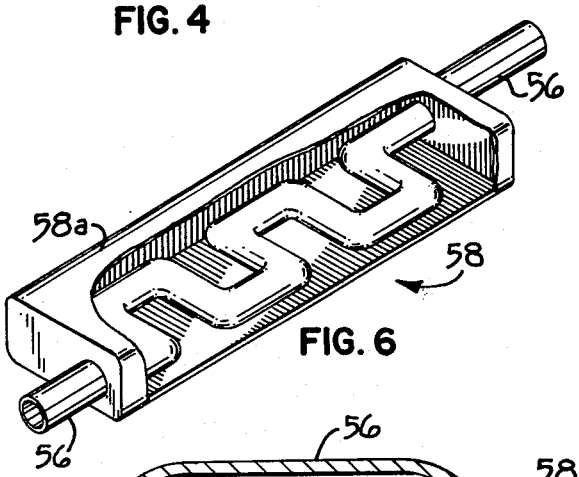
FIG. 6 is a perspective view, with portions thereof broken away, of a spark arrester assembly insertable within the exhaust feedback path to the carburetor, disclosed in FIG. 1.
Figure 8:
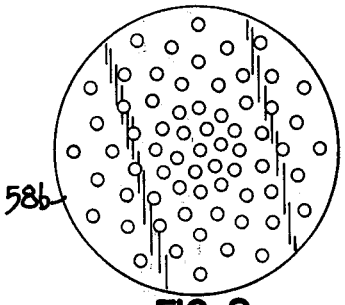
FIG. 8 is an enlarged view of one of the screen interface members of the spark arrester assembly disclosed in FIG. 7.
Figure 7:
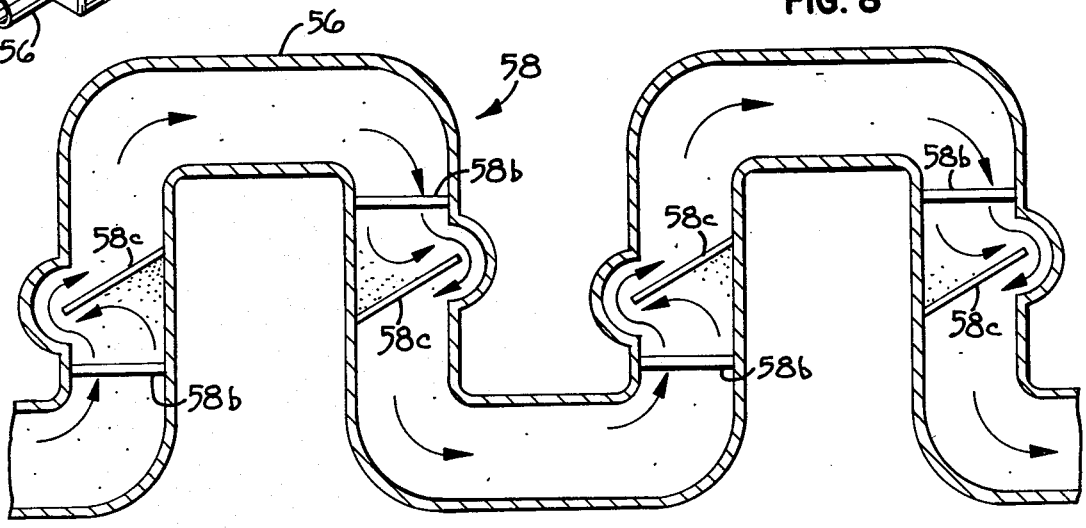
FIG. 7 is an enlarged fragmentary detail of a portion of the spark arrester assembly disclosed in FIG. 6.

The present invention includes an exhaust feedback apparatus for partially recycling exhaust gases from the exhaust output port 26 of the combustion cylinder 23. The exhaust feedback structure is schematically illustrated in FIG. 1. A portion of the exhaust gases being ejected through the exhaust manifold 54 are recycled through the exhaust gas recycling conduit 56, and pass through the spark arrester assembly 58 for reuse by the carburetor 52. the screw valve 59 provides means for regulating the rate of flow of exhaust gases through the feedback conduit 56, which can be completely closed thereby if desired. A more detailed description of the spark arrester assembly 58 is illustrated in FIGS. 6–8. Referring thereto, the spark arrester assembly 58 generally includes an outer heat shield member 58a through which the exhaust recycling conduit 56 passes in serpentine-like manner. Within the serpentine-like configuration, the exhaust feedback conduit includes a plurality of screen interface members 58b which disperse and deenergize spark or hot particulate particles in the exhaust. An enlarged view of one typical interface member is illustrated in FIG. 8. Following each of the screen interface members 58b is a spark deflector member 58c which is mounted at an angle (as illustrated in FIG. 7) so as to deflect and remove hot spark or particulate particles from the exhaust flow. The exhaust feedback conduit member 56 is enlarged adjacent the free end of each of the spark deflector members 58b to force the exhaust gases around the spark deflector members 58c such that the larger particulate hot particles will remain entraped by the spark deflectors 58c, leaving the cleaner exhaust gases to pass there around. The spark arrester assembly 58 serves to remove burning particles from the exhaust gases and to cool the exhaust gases prior to allowing passage thereof into the carburetor, to prevent pre-combustion of intake gases either within the carburetor or the intake manifold, which could be caused by hot particulate or spark particles injected from the feedback exhaust gases.

OPERATION OF THE PREFERRED EMBODIMENT

From the foregoing description, operation of the rotary valve engine above-described in fairly self-evident. The crank shaft 28 turns the rotary valve member 44 by means of the timing and gear assembly comprising the gears 29 and 34 and the connecting drive chain 36. In the preferred embodiment, the combustion cylinder 23 operates on a well-known four-cycle combustion sequence. The intake and exhaust valve access ports 47 and 48 are disposed on the rotary valve member 44 in circumferential relationship to one another such that the intake access port 47 aligns with and provides fluid communication with the intake port of the combustion cylinder 23 during the "intake" quarter of the complete combustion cycle, and the exhaust valve port 48 aligns with the exhaust port of the combustion cylinder 23 during the "exhaust" stroke of the complete combustion cycle. As the intake and exhaust ports 47 and 48 respectively align with the plunger assemblies 60, direct fluid communication is provided between the respective intake or exhaust manifolds 50 and 54 respectively and the internal combustion chamber **23*b* of the combustion cylinder 23. As the rotary valve member 44 rotates in timed cooperative relationship with the crank shaft 28**, the well-known four-cycle sequence is established: (1) piston moves down — intake stroke; (2) piston moves up — compression stroke; (3) spark ignition forcing piston down — power stroke; and (4) piston moves up — exhaust stroke.

The blade or vane members **44*c* and 44*e* on the intake and exhaust passageways 44*b* and 44*d* respectively around the outer circumference of the rotary valve member 44, provide a blower effect for positively transferring the respective gaseous mixtures between the internal cavity portions 44*a* of the rotary valve member and the respective intake and exhaust manifolds 50 and 54 respectively. The impeller assembly 80 located adjacent the intake valve access port 47, further insures positive injection of the gaseous intake mixture to the combustion cylinder 23 on the "intake" stroke of the cycle. Since the internal cavity 44*a* of the rotary valve member 44, which lies adjacent the intake valve access port 47 is always filled with a pressurized combustible gaseous mixture, as soon as the intake valve access port 47 aligns with the double plunger seal assembly 60 during the intake stroke of the cycle, the gaseous intake mixture is immediately positively injected into the combustion cylinder 23**, thus significantly increasing the efficiency and horsepower of the engine.

The laminated seal members 49 mounted external of the rotary valve member 44 and the internal plug members 46 in cooperation with the closed-end cylindrical casing member 81 of the impeller assembly insure adequate fluid-flow preventing seals between the respective intake and exhaust portions of the rotary valve assembly, in a simple and easy repairable method. The cylindrical construction of the rotary valve member, coupled with the simplicity of construction of the various seals and bearing members operatively associated therewith, provides for rapid installation and easy maintenance of the valve assembly. The two-part outer housing 42 enable easy removal of the rotary valve assembly by simply removing the upper housing portion **42*a*** thereof.

The fail-safe double-acting plunger seal assembly 60 minimize the effects of wear on the valve portion of the engine, and insure tight sliding seals of the inner and outer sealing plunger members 69 and 66 respectively with the rotary valve member 44, even with significant wear of the respective plunger elements, by means of the equalizing lever 63 and biasing spring 70 combination. Accordingly, the wear and tear of the prior art poppet-type of valve are eliminated and the unique construction of the double plunger seal assembly 60 enables rapid replacement and maintenance of the plunger seal assemblies, if required.

Reburning of exhaust gases is provided by the recycling conduit 56 and spark arrester assembly 58, to further increase efficiency of operation of the internal combustion engine assembly.

Other modifications of the invention will be apparent to those skilled in the art in light of the foregoing description. This description is intended to provide concrete examples of individual embodiments clearly disclosing the present invention. Accordingly, the invention is not limited to any particular embodiment. All alternatives, modifications and variations of the present invention which fall within the spirit and broad scope of the appended claims are covered.

What is claimed is:

1. Improved rotary valve apparatus for use with an internal combustion engine of the type having at least one internal combustion cylinder, a piston mounted for reciprocated movement therein, one end of said piston cooperatively defining with one end of said cylinder an internal combustion chamber, means for reciprocating said piston within said cylinder between first and second positions, ignition means for igniting combustible fuels within said combustion chamber in timed sequence with the reciprocatory movement of said piston, carburetor means for providing a combustible fuel and air mixture, intake manifold means operatively connected to said carburetor means for directing the combustible fuel therefrom, and exhaust manifold means for directing exhaust fumes from said combustion chamber, the improvement comprising:

(a) a valve housing defining a valve bore extending transversely of said cylinder, said intake and exhaust manifold means being operatively connected to said valve housing at longitudinally spaced positions therealong and in open communication with said valve bore;

(b) a cylindrical rotary valve disposed for rotation about its longitudinal axis in said valve bore, said rotary valve comprising a cylindrical shell defining an inner cylindrical valve cavity and having longitudinally spaced first and second intake ports and first and second exhaust ports formed through said shell to provide fluid communication between said valve bore and said inner valve cavity;

(c) first seal means within said rotary valve cavity for subdividing said cavity into intake and exhaust valve chambers, said first and second intake ports being disposed to open into said intake valve chamber, and said first and said second exhaust ports being disposed to open into said exhaust chamber;

(d) a plurality of bearings coaxially mounting said rotary valve for rotation within said valve bore, said rotary valve being longitudinally disposed within said bore such that said first intake and said first exhaust ports respectively thereof cooperatively address the intake and exhaust manifold means respectively;

(e) a plurality of anti-friction seal members cooperatively mounted in said valve bore and spaced apart axially thereof providing a fluidic seal between said housing and said rotary valve, at least one said anti-friction seal member being axially disposed on either side of said intake ane exhaust valve chambers;

(f) intake and exhaust plunger assembly means operatively mounted for selectively providing fluid flow communication respectively between said intake and exhaust chambers respectively and the internal combustion chamber, each of said intake and exhaust plunger assembly mean comprising:

(i) an outer casing member operatively connecting said valve housing with said internal combustion cylinder, providing fluid communication between said valve bore and said internal combustion chamber;

(ii) at least one plunger member slidably mounted within said outer casing, said plunger member defining an internal cavity longitudinally extending therethrough and having an arcuately shaped end and configured to slidably engage the outer cylindrical surface of said rotary valve shell, said respective intake and exhaust one plunger members being mounted to cooperatively address said second intake and said second exhaust ports of said rotary valve to selectively provide fluid communication between said inner valve cavity and said internal combustion chamber through said respective second intake and said second exhaust ports; and (iii) spring means operatively mounted within said outer casing member for biasing said arcuate end of said one plunger member into sliding sealing engagement with said rotary valve; and (g) wherein said second intake and said second exhaust valve ports respectively are relatively circumferentially spaced around the outer surface of said rotary valve shell and in cooperative alignment with said respective intake and exhaust plunger assemblies for providing timed fluid communication between said rotary valve and said internal combustion chamber during the intake and the exhaust strokes respectively of a combustion cycle.

2. An improved rotary valve apparatus as recited in claim 1, wherein said valve housing is generally cylindrical in shape and is longitudinally segmentable along its length to provide rapid access to said valve bore for removal of said rotary valve.

3. An improved rotary valve apparatus as recited in claim 1, further including vane means mounted adjacent said first intake valve port for providing positive blower action to fluid flowing through said first intake port and into said intake valve chamber upon rotation of said rotary valve.

4. An improved rotary valve apparatus as recited in claim 3, wherein said first intake valve port comprises a plurality of circumferentially spaced openings formed in an annular ring through the outer shell of said rotary valve, and wherein said vane means comprise projections from said rotary valve shell which are disposed across the circumferentially spaced first intake valve openings for positively directing fluid flow through said first intake valve openings upon rotation of said rotary valve.

5. An improved rotary valve apparatus as recited in claim 3, further including impeller means mounted within said intake valve chamber and responsive to rotation of said rotary valve, for atomizing combustible fuel mixtures within said intake valve chamber and for providing pressurized flow of fluid through said intake valve chamber from said first intake valve port to said second intake valve port thereof.

6. An improved rotary valve apparatus as recited in claim 1, further including impeller means mounted within said intake valve chamber and responsive to rotation of said rotary valve, for atomizing combustible fuel mixtures within said intake valve chamber and for providing pressurized flow of fluid through said intake valve chamber from said first intake valve port to said second intake valve port thereof.

7. An improved rotary valve apparatus as recited in claim 6, wherein said impeller means comprises: an impeller blade; means for axially mounting said impeller blade for rotation within said intake valve chamber; and gear means responsive to rotation of said rotary valve for rotating said impeller blade.

8. An improved rotary valve apparatus as recited in claim 7, further including lubrication means for lubricating said impeller means upon rotation of said rotary valve.

9. An improved rotary valve apparatus as recited in claim 1, further including lubrication means for lubricating said bearings upon rotation of said rotary valve.

10. An improved rotary valve apparatus as recited in claim 1, further including vane means mounted adjacent said first exhaust valve port for providing positive blower action to fluid flowing through said first exhaust port from said exhaust valve chamber, upon rotation of said rotary valve.

11. An improved rotary valve apparatus as recited in claim 10, wherein said first exhaust valve port comprises a plurality of circumferentially spaced openings formed in an annular ring through the outer shell of said rotary valve, and wherein said vane means comprises projections from said rotary valve shell which are disposed across said circumferentially spaced first exhaust valve openings for positively directing fluid flow through said first exhaust valve openings and into said exhaust manifold, upon rotation of said rotary valve.

12. An imporved rotary valve apparatus as recited in claim 1, wherein said first seal means comprises a disc-like plug member frictionally mounted within said inner valve cavity of said rotary valve, for subdividing said cavity into said intake and exhaust valve chambers.

13. An improved rotary valve apparatus as recited in claim 1, wherein said second seal members comprise laminated anti-friction seal members comprising a first annular band press-fit onto the outer shell of the rotary valve and defining a plurality of annular space ridges, and a second annular band defining a plurality of annular spaced ridges configured for cooperative mating alignment with said spaced ridges of said first annular band and configured for mounting within said valve bore of said housing so as to move in close cooperative non-touching relationship with said first annular band upon rotation of said rotary valve, whereby said close non-touching relationship of said first and said second annular bands severly impede fluid-flow passage therebetween.

14. An improved rotary valve apparatus as recited in claim 1, wherein said intake and exhaust plunger assemblies further each include a second, inner plunger member slidably mounted within the internal cavity of said one plunger member, said inner plunger member defining an internal cavity longitudinally extending therethrough and having an arcuately shaped end configured to slidably engage the outer cylindrical surface of said rotary valve shell, and wherein said spring means includes biasing means operatively engaging both said one and said inner plunger members for urging the arcuate ends respectively of both of said plunger members into matingly tight sliding engagement with said rotary valve.

15. An improved rotary valve apparatus as recited in claim 14, wherein said spring biasing means includes pressure equalizing lever means operatively connected with said one and said inner plunger members for equalizing and maintaining the sliding engagement pressure applied to said one and said inner plunger members, whereby tight sliding seal engagement of said one and said inner plunger members is maintained independent of wear of said plunger members and said rotary valve caused by operative rotation of said rotary valve.

16. An improved rotary valve apparatus as recited in claim 1, further including exhaust recycling means operatively connected between the exhaust mainfold and the carburetor of said internal combustion engine for recycling a portion of the exhaust gases discharged from said internal combustion chamber, to the intake manifold.

17. An improved rotary valve apparatus as recited in claim 16, wherein said exhaust recyclying means includes spark arrester means for removing hot particulate objects from the recycled exhaust gases.

18. An improved rotary valve apparatus as recited in claim 17, wherein said spark arrester means comprises a serpentine-shaped tube member defining an internal passageway through which the recycled exhaust gases flow, a plurality of screen interface members disposed across the internal passageway of said serpentine tube member, and spark deflector members projecting from the walls of said serpentine tube member at longitudinally spaced positions therealong for intercepting hot particulate particles passing through said tube member.

19. An improved rotary valve apparatus as recited in claim 16, further including fluid flow control means operatively connected within the exhaust recycling means path, for regulating the rate of flow of exhaust gases through said recycling means.

20. The combination with a rotary valve internal combustion engine of the type comprising: and engine body with at least one internal combustion cyclinder; a valve housing defining a valve bore extending transversly of said cylinder; tube means for connecting in fluid communication one end of said internal combustion cylinder with said valve bore; a piston operable in said cylinder; a cylindrical rotary valve mounted for rotation within said valve bore, said rotary valve defining an inner axially extending cylindrical valve cavity subdividing into intake and exhaust chambers and having intake and exhaust ports through the walls of said rotary valve, said rotary valve being operable to control fluid communication with said cylinder through said intake and exhaust ports and said tube means; means for rotatably mounting said rotary valve in said valve bore; means for providing combustible gaseous fluids to said intake chamber; and means for directing gaseous exhaust fluids from said exhaust chamber; of a double plunger assembly mounted within said tube means for providing uniform tight sealing engagement between said rotary valve and said internal combustion chamber, one each of said double plunger assemblies being mounted to cooperatively respectively address each of said intake and exhaust ports of said rotary valve, each of said double plunger apparatus comprising:

(a) an outer plunger member slidably mounted within said tube means and defining an internal cavity longitudinally extending therethrough, said outer plunger member having an arcuately shaped end configured to slidably engage the outer cylindrical surface of said rotary valve;

(b) an inner plunger member slidably mounted within the internal cavity of said outer plunger member and defining an internal cavity longitudinally extending therethrough, said inner plunger member having an arcuately shaped end configured the slidably engage the outer cylindrical surface of said rotary valve;

(c) spring means operatively engaging both said inner and said outer plunger members for urging the arcuate ends respectively thereof into matingly tight sliding engagement with said rotary valve.

21. The apparatus of claim 20, wherein said spring biasing means includes pressure equalizing lever means operatively connected with said inner and said outer plunger members for equalizing and maintaining the sliding engagement pressure applied to said inner and said outer plunger members, whereby tight sliding seal engagement of said inner and said outer plunger members is maintained independent of said respective plunger members and said rotary valve caused by the operative rotation of said rotary valve.

22. The apparatus of claim 20, further including alignment means operatively mounted between said inner and said outer plunger assemblies for maintaining the relative rotational attitude of said inner and said outer plunger members relative to one another.

* * * * *